US006983754B1

(12) United States Patent
Anderson et al.

(10) Patent No.: US 6,983,754 B1
(45) Date of Patent: Jan. 10, 2006

(54) BAG WASHING APPARATUS AND METHOD

(76) Inventors: Randy M. Anderson, 4816 12th Ave. S., Minneapolis, MN (US) 55417; Jeannie L. Piekos, 4816 12th Ave. S., Minneapolis, MN (US) 55417

( * ) Notice: Subject to any disclaimer, the term of this patent is extended or adjusted under 35 U.S.C. 154(b) by 219 days.

(21) Appl. No.: 10/686,132

(22) Filed: Oct. 14, 2003

Related U.S. Application Data

(60) Provisional application No. 60/417,920, filed on Oct. 11, 2002.

(51) Int. Cl.
*B08B 9/093* (2006.01)
*A47F 7/00* (2006.01)

(52) U.S. Cl. ..... 134/22.1; 134/22.18; 134/25.2; 134/25.3; 211/12; 248/95

(58) Field of Classification Search ..... 134/22.1, 134/22.18, 25.2, 25.3; 211/12, 85.15; 248/95
See application file for complete search history.

(56) References Cited

U.S. PATENT DOCUMENTS

| | | | |
|---|---|---|---|
| 63,383 | A | 4/1867 | Hanks |
| 3,289,854 | A | 12/1966 | Kauffman |
| 3,451,557 | A | 6/1969 | Stoddard |
| 4,593,822 | A | 6/1986 | Yeaney et al. |
| 4,748,993 | A | 6/1988 | Llewellyn |
| 4,921,195 | A | 5/1990 | Clark et al. |
| 4,974,806 | A | 12/1990 | Matern |
| 5,080,237 | A | 1/1992 | Hefner |
| 5,102,076 | A | 4/1992 | North et al. |
| 5,188,244 | A | 2/1993 | Hollstegge |
| 5,405,018 | A | 4/1995 | Anthrop, Jr. |
| 5,538,050 | A | 7/1996 | Galdon |
| 5,641,137 | A | 6/1997 | Collier |
| 5,794,792 | A | 8/1998 | Convertino |
| 5,918,749 | A | 7/1999 | Pille et al. |
| 6,243,967 | B1 | 6/2001 | Dovolas |
| 6,557,567 | B2 * | 5/2003 | Mood ..... 134/22.18 |

* cited by examiner

*Primary Examiner*—Michael Barr
*Assistant Examiner*—Saeed Chaudhry
(74) *Attorney, Agent, or Firm*—Albert W. Watkins

(57) ABSTRACT

A support structure and method, designed to maintain a resealable plastic bag in an open position within a dishwasher through the washing and drying cycles, has at least two vertically extending support and restraining straps that may be engaged with like straps to form a resilient support framework. A plurality of mating dimples and protrusions offer controlled size adjustments, while maintaining the reliability of the structure. The structure is readily collapsible to a flat and compact structure prior to purchase and when not in use, and includes features to engage with the rack in the dishwasher to prevent the support and bag from being substantially relocated during the wash process.

19 Claims, 3 Drawing Sheets

BAG WASHING APPARATUS AND METHOD

CROSS REFERENCE TO RELATED APPLICATIONS

This application claims priority to U.S. provisional application Ser. No. 60/417,920 filed Oct. 11, 2002 and herewith, the contents which are incorporated herein by reference in entirety.

BACKGROUND OF THE INVENTION

1. Field of the Invention

This invention pertains generally to supports, and more particularly to frames for holding the mouth of a bag open and properly oriented within a dishwasher and for drying subsequent to washing.

2. Description of the Related Art

Food service has long been understood to be vital for the survival of a civilization. Much effort has been put into the preparation, packaging and delivery of foods in healthy and sanitary way, to avoid the risk of illness or, in extreme cases, death.

As a result of the knowledge that has evolved regarding the growth and proliferation of microbes and parasites, many practices have evolved in the areas of food service and food preparation, and even a substantial amount of regulation has been promulgated. These practices and regulations are, of course, aimed at maintaining the health and vitality of all persons.

One of the foremost requirements that all kitchens and food service establishments must obey is the sanitary handling, preparation and storage of meat. This is because the possibility of contamination of the foods with such pathogens as salmonella, *e-coli* and other harmful bacteria, and the undesirable proliferation of such harmful bacteria with improper storage, can lead to severe sickness and death. Moreover, while with other types of foods the possibility exists for microbial contamination, the incidence of sickness and death is generally thought to be far higher with improperly handled meat.

In recognition of the importance of proper handling, a number of companies have introduced packaging which is designed for secure storage and protection of a food item, but which is manufactured inexpensively enough to be handled as a single use package. The benefit of a single use package is apparent, in that there is no risk of food contamination or cross-contamination. When a bag has been used, it may simply be disposed of. While other manufacturers have introduced various boxes and other packages for re-useable food service, these containers have not met with the same success, owing to the need to thoroughly clean such containers after the use with meats. Furthermore, the cost of the re-useable packaging has typically been extraordinarily high when compared to single used bags, and when a container is accidentally forgotten for an extended period, such as when a lunch box is left in a car trunk or the like, the re-useable container may be unsalvageable. So, while in theory the re-useable packaging may offer benefit and advantage over single use bags, this economy has not, in practice, been fully experienced. As is known then, the vast majority of foods are transported not in re-useable containers, but in single use bags. In the event a bag was left with food for an extended period, the bag could simply be disposed of.

Among the more environmentally or economically conscious consumers, there has been a practice in the past of washing these bags for re-use. In some instances, the decision whether to wash and re-use or to dispose has been made based upon what the bag contained. If, for example, the bag contained carrot sticks or peanut butter and jelly sandwiches, the bag might be washed, dried and later re-used. If instead the bag had been used for a meat sandwich or other meat product, the bag would instead be disposed of. This need for continuing to dispose of the bag was motivated in part by the difficulty of reliably cleaning the bags. Many of the bags have features that are provided to ensure the bag is securely sealed, which will also ensure that there is no opportunity for cross-contamination between one type of food and another. Consequently, these features have been widely adopted by food bag manufacturers. Unfortunately, these features will also typically create small seams or folds that may be quite difficult to clean thoroughly. Similarly, many of these bags have very small corners which provide little access for thorough cleaning. Consequently, the effort required to thoroughly and reliably clean the bags has been generally thought to be far greater than the worth of the bag.

In apparent response to the limitations of the prior art, several artisans have attempted to design stands for bags that will facilitate the cleaning or re-use thereof. Exemplary of these are U.S. Pat. No. 5,794,792 to Convertino, U.S. Pat. No. 5,405,018 to Anthrop, Jr.; and U.S. Pat. No. 5,538,050 to Galdon, the teachings of each which are incorporated herein by reference. Each of these patents illustrate the concept of holding a bag within a dishwasher for cleaning, though the structure that they use has not met with success for various reasons. One of the limitations of the prior art is the inability to adequately and reliably hold a bag through a standard dishwashing cycle. The bags will tend to be driven by the force of the water jets from the bag holder, and then the bags become entangled within the internal washing compartment or alternatively become entangled within the pump at the bottom of the dishwasher. In either case, the bag has not only not been cleaned, but it has also presented a nuisance which can disrupt the use and application of the entire dishwasher. Not only may this release of the bag result in the need to re-wash the bag, but in some instances the entire load. The resultant mayhem may disrupt the regular cycles and routines of the users of the dishwasher, such that other needed dishes are not washed when most desired. Consequently, the inconvenience and mess that may arise from inadequately restraining a bag may lead to sufficient discontent that the owner refuses to use such apparatus ever again.

Another problem encountered by the prior art is a lack of adequate flexibility to accommodate different types or sizes of bags. There is much dimensional variation between sandwich bags and gallon bags. When a prior art bag washer was used, it would have been either a one-size-fits-all approach, where one bag holder would be used for every size of bag from snack bag to gallon bag, or there would have been many parts or much complexity to accommodate these variations. One of the more difficult challenges has been the adequate maintenance of passage of water into the corners or extremes of a bag. The smaller regions must be kept sufficiently open for the wash water to pass therein, and yet must also be maintained in a generally upright position to allow the water to drain immediately back out. When the bag has too much of a corner unsupported, when the wash water travels in it has a tendency to collect and push the corner down in a "dog-eared" position, trapping the water within the corner and preventing the full cleaning and sanitation of the bag which is necessary for safe and reliable cleaning. Yet, the placement of a structure within the bag to support the corner may instead block the corner from the entry of wash water.

Consequently, a need exists to provide a better alternative to users of disposable bags.

SUMMARY OF THE INVENTION

In a first manifestation, the invention is a plastic bag support for retaining a plastic bag within a dishwasher to assist with the cleaning thereof. At least two vertically extending bag supporting and restraining straps each have an indeterminate length resilient body and a bag retainer. At least one of the two vertically extending bag supporting and restraining straps has a coupling member suitable for engaging an indeterminate length body and coupling the strap to an indeterminate length body of another of the straps at a coupling location that is adjustable through a range of positions. A means is further provided for engaging a dishwasher rack.

In a second manifestation, the invention is, in combination, a plastic bag, a dishwasher rack, and a bag holder having at least two vertically extending flexible and resilient straps serving to support the bag and having a releasable attachment to the dishwasher rack. The at least two vertically extending flexible and resilient straps have a coupling member coupling the at least two vertically extending flexible and resilient straps together at a coupling location that is adjustable through a range of positions, to vary a combined length of the at least two vertically extending flexible and resilient straps.

In a third manifestation, the invention is a method of washing a plastic bag in an automatic dishwasher. According to the method, a first generally linear bag supporting and restraining strap is aligned with a second generally linear bag supporting and restraining strap. The aligned first generally linear bag supporting and restraining strap is pressed transversely to a longitudinal axis against the second bag supporting and restraining strap to engage an operatively stable coupling therebetween. First and second bag supporting and restraining straps are then folded into a loop, and coupled and folded first and second bag supporting and restraining straps are engaged with the automatic dishwasher. The first bag supporting and restraining strap is slid relative to the second bag supporting and restraining strap to adjust a combined length to coincide with an interior opening in the plastic bag; and the plastic bag is affixed to the coupled first and second bag supporting and restraining straps.

OBJECTS OF THE INVENTION

Exemplary embodiments of the present invention solve inadequacies of the prior art by providing a set of universal straps that are readily adapted to varying bag sizes. The straps are easily placed and configured, and are most preferably manufactured from a material which will permit permanent or semi-permanent storage within a dishwasher. Most preferably, a special arrangement upon the strap is provided for securely engaging a bag, and a feature is provided for tying each of the straps together about a base hoop.

A first object of the invention is to provide an easy-to-use apparatus which will reliably operate in association with an automatic dishwasher to clean and sanitize disposable food bags. A second object of the invention is to provide such apparatus in an extremely compact form which may be readily stored and shipped, and which requires a minimum of storage space when not in use, and which will also block a minimum amount of water during the washing cycle. Another object of the present invention is to limit the amount of materials used in the manufacture of the apparatus. A further object of the invention is to provide such apparatus for permanent or semi-permanent storage within the dishwasher, but around which standard dishes may be placed when said apparatus is not in use, to not unnecessarily consume space within said dishwasher. Yet another object of the present invention is to incorporate sufficient technology into the design of the apparatus to enable the production of standard tooling using a minimum of piece parts and consequently a minimum of unique tools required for production. An even further object of the invention is to provide a bag washing apparatus which is pliable and resilient, whereby the possibility for damage resulting from the use of the bag washer is substantially reduced.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
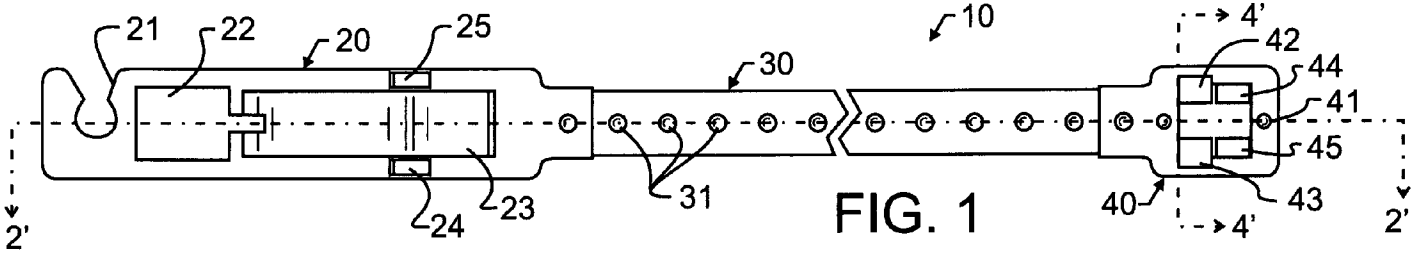
FIG. 1 illustrates a preferred embodiment adjustable strap designed in accord with the teachings of the present invention from a top plan view.

Manifested in the preferred embodiment, the present invention provides a bag supporting and restraining strap 10 having a base member 20, an indeterminate length body 30, and a coupling member 40 distal to base member 20. Base member 20 will preferably include a method of anchoring or attachment to a dishwasher rack, thereby permitting bag supporting and restraining strap 10 to stay in place during the agitation that comes from pulsating water jets commonly used in dishwashers. While these keyhole anchors 21 are in the preferred embodiment provided on bag supporting and restraining strap 10, it will be understood that they may be alternatively provided in other ways, such as being formed integrally with or suspended from base ring 60 visible in FIGS. 5–8. By providing keyhole anchors 21 at the base of bag supporting and restraining strap 10, the attachment points to a dishwasher rack may be varied as required simply by repositioning bag supporting and restraining strap 10.

Immediately adjacent keyhole anchor 21 is base ring engaging slot 22, which is adapted to encircle base ring 60. In the preferred embodiment, this will be achieved by sliding base ring 60 through base ring engaging slot 22. Most preferably, base ring 60 will fit reasonably snugly within base ring engaging slot 22, most preferably maintaining bag supporting and restraining strap 10 relatively perpendicular to base ring 60. In this position, bag supporting and restraining strap 10 rises vertically from the dishwasher rack, and is prevented through interference with base ring 60 at base ring engaging slot 22 from falling significantly away from vertical.

Figure 2:
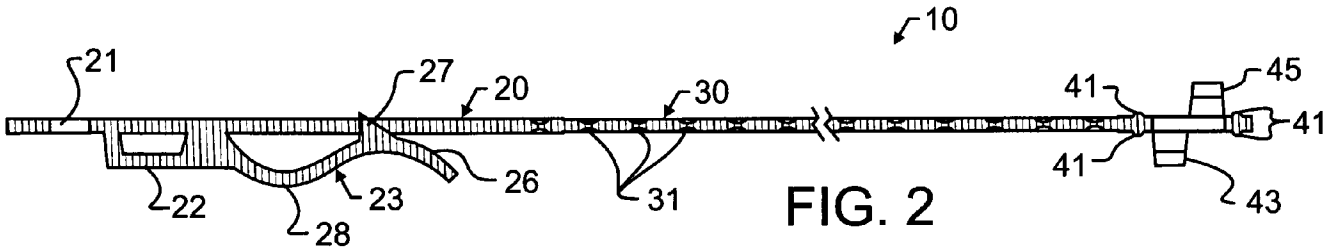
FIG. 2 illustrates the preferred embodiment adjustable strap of FIG. 1 from a cross-section view taken along section line 2' of FIG. 1.
Figure 3:
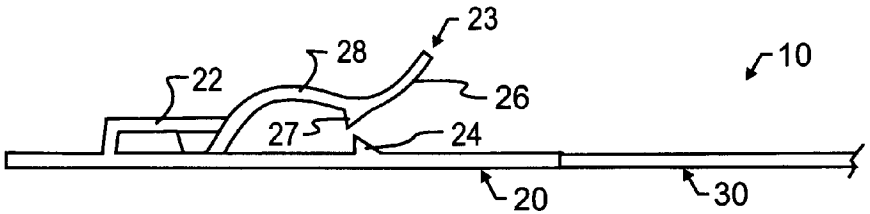
FIG. 3 illustrates the bag retaining end of the preferred embodiment adjustable strap of FIG. 1 from a side partial view.

Adjacent to base ring engaging slot 22 is a bag retaining clip 23 and two counter-facing teeth 24, 25. Bag retaining clip 23 includes a tooth 27 sloped to readily permit the lip of a bag, in particular such as are found on the special zipper bags or the like, to readily slide from open curve 26 past tooth 27, and into position adjacent spring body 28. While typically requiring a small amount of manual force to open tooth 27 away from counter-facing teeth 24, 25, the amount of force required is negligible owing to the desired pliability of the material from which bag retaining clip 23 is fabricated. Once a bag lip or other feature has passed between tooth 27 and counter facing teeth 24, 25, the tooth geometry is such that a simple tug such as was sufficient to insert a bag lip is insufficient to remove a bag lip therefrom. The position of FIG. 2 with tooth 27 extending well offset from and overlapping counter-facing teeth 24, 25 is most preferred. FIG. 3 illustrates bag retaining clip 23 in a nearly open position, with tooth 27 no longer overlapping with counter-facing teeth 24, 25. As may now be apparent, once open curve 26 is lifted away from counter-facing teeth 24,25, tooth 27 begins to re-orient as well, and is deflected to where pulling on a bag lip inserted within bag retaining clip 23 will cause open curve 26 to further lift away, thereby allowing the bag lip to pass back out of spring body 28. To enhance this action, each of the teeth 24, 25, 27 are provided with a face which is essentially perpendicular to the plane of the surface. This perpendicular face preferably is most adjacent spring body 28, which means that there is a steep angle of engagement between a bag and these teeth when the bag has already been inserted, and is being pulled out. The face of a tooth being primarily acted upon by forces from a bag will be understood for the purposes of this disclosure to be the active face for so long as the face remains the one being primarily acted upon. Such steep angle effectively requires a great force in the longitudinal direction of bag supporting and restraining strap 10 to spread bag retaining clip 23 from counter-facing teeth 24, 25. Coming from an outside during insertion, the bag will encounter much more gentle angles of inclination of each of the teeth, and so consequently may be inserted much more easily. This geometry of the teeth is most preferred, since a bag may simply be slipped between the teeth when being placed within bag supporting and restraining strap 10. When being removed therefrom, a manual flexure of bag retaining clip 23 will most readily release a bag. Absent the manual flexure, a bag will be retained sufficiently tightly in place to stay put during an automatic dishwashing cycle.

Adjacent base member 20 is indeterminate length body 30, which, as the name implies, may be designed to be any suitable length desired. Most preferably, this length will accommodate a reasonable number of bag sizes, while not interfering with the operation of a dishwasher. Preferably spaced along indeterminate length body 30 are dimples 31. Dimples 31 may be provided most preferably at evenly spaced intervals, but there is no requirement for the same.

Figure 4:
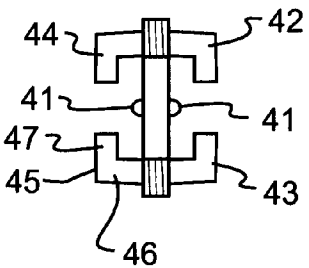
FIG. 4 illustrates the coupling end of the preferred embodiment adjustable strap of FIG. 1 from a cross-section view taken along section line 4' of FIG. 1.

Coupling member 40 terminates indeterminate length body 30, and provides features which will readily couple with a like designed indeterminate length body 30. As visible in particular in FIG. 4, protruding bumps 41 are provided on both of the major faces of coupling member 40, which will be understood herein to be the larger generally planar surfaces, as opposed to the minor surfaces which are the edges. Protruding bumps 41 are designed to cooperate with dimples 31 to provide stepwise engagement, and consequently restrict undesired slippage between coupling member 40 and an indeterminate length body 30. Extending also from opposed major surfaces of coupling member 40 are two sets of clips designed to engage or encompass an indeterminate length body 30. Most preferably, these clips 42–45 are arranged so that adjacent pairs will receive, but only with some resilient deformation, an indeterminate length body 30 with the primary motion therebetween being a motion where indeterminate length body 30 is first extended parallel to and adjacent with coupling member 40, and then is pressed together sufficiently to deform clips ends such as end 47, thereby allowing indeterminate length body 31 or an equivalent within arms 44, 45, for example. Because it will not generally be known in advance which one of a pair of similar bag supporting and restraining straps such as strap 10 will be on which side relative to each other, assembly is simplified by providing arms 42 and 43 on one side of coupling member 43 and another pair of like arms 44, 45 on an opposed surface. Furthermore, protruding bumps 41 are similarly provided on both sides, as are each of the many dimples 31.

Figure 5:
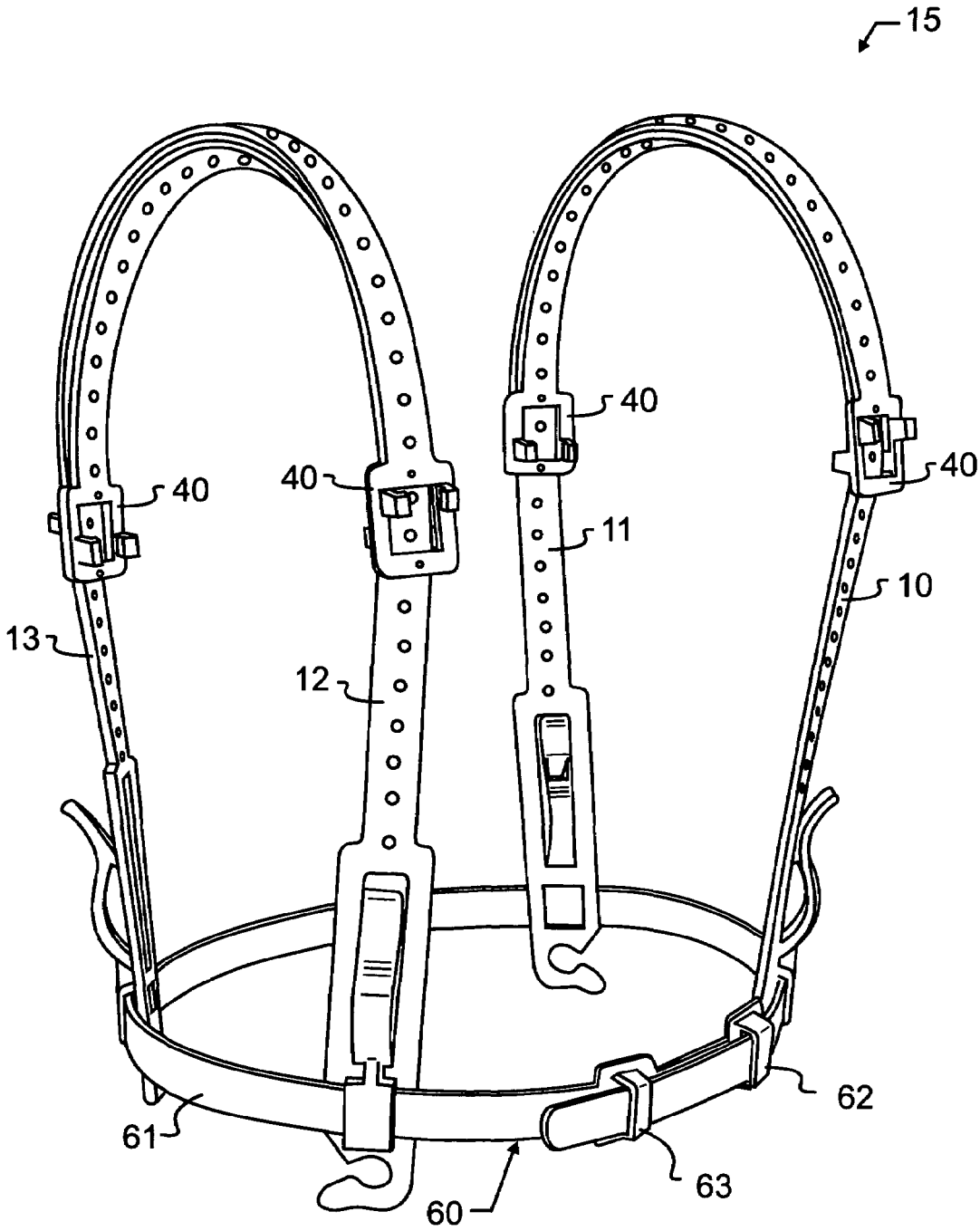
FIG. 5 illustrates a preferred embodiment bag washing apparatus incorporating four adjustable straps of like construction to that illustrated in FIG. 1, from a projected plan view.
Figure 6:
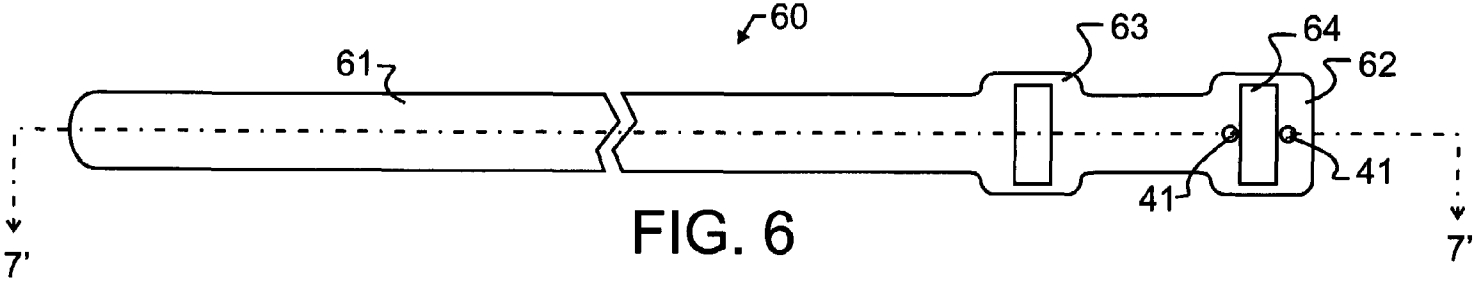
FIG. 6 illustrates a preferred embodiment adjustable base ring designed in accord with the teachings of the present invention from a top plan view.
Figure 8:
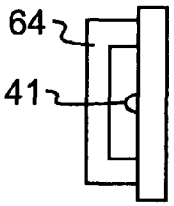
FIG. 8 illustrates the adjustable base ring of FIG. 6 from an end view.
Figure 7:
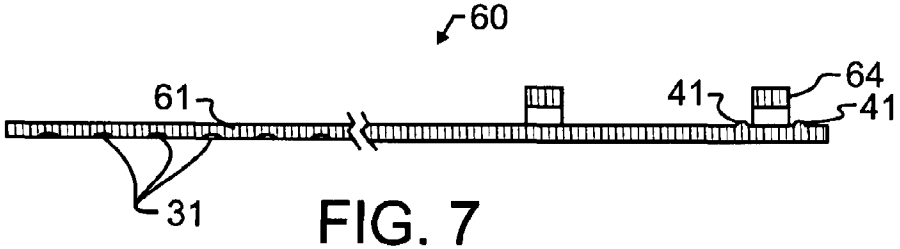
FIG. 7 illustrates the preferred embodiment adjustable base ring of FIG. 6 from a cross-section view taken along section line 7' of FIG. 6.

As best visible in FIG. 5, four bag supporting and restraining straps 10–13 are provided to form a complete bag washing apparatus 15, each of the straps which share the features of bag supporting and restraining strap 10. These straps extend generally perpendicular to base ring 60, and may be arranged to form two non-overlapping loops as shown in the figure, which is most preferred, but may alternatively be arranged to have one loop overlap the other by coupling with a bag supporting and restraining strap on a side opposite, rather than with the adjacent bag supporting and restraining strap. The benefit of a non-overlapping arrangement is that dishes may be placed into the dishwasher immediately adjacent to and even within the confines of base ring 60 when a bag is not also being cleaned. An additional advantage of the arrangement illustrated in FIG. 5 is the ability to control the placement of bag supporting and restraining straps 10–13 about base ring 60. While not immediately apparent, base ring 60 maintains the orientation of base members 20 to be tangential thereto. Consequently, when two base members 20 are brought more closely together on base ring 60, the associated indeterminate length bodies 30 will be twisted, and will tend to bow outwards. This can be particularly advantageous in the cleaning of larger bags. A small part of this effect is visible in FIG. 5, where there is some twisting illustrated. Other apparatus or techniques may be employed in the anchoring of bag supporting and restraining straps than the use of base ring 60 and keyhole anchors 21. Means may be devised to attach directly to dishwasher rack structure, as has been demonstrated by others such as Anthrop incorporated by reference herein above, or may alternatively include features built into the rack or dishwasher at the time of manufacture. Nevertheless, for the flexibility in layout and capability of fitting essentially all existing dishwashers, the preferred embodiment incorporates base ring 60.

Since there are no rigid attachments between bag supporting and restraining straps 10–13, coupling members 40 may readily be slid into appropriate position for a particular size of bag being supported thereon. Bag supporting and restraining straps 10 and 11 may overlap by any amount ranging from just overlapping beyond each other's coupling members 40, which is almost the sum of the two straps' lengths, to almost completely overlapping, which is just slightly more than the length of the longest one of the straps. This change in length will be readily made manually, by sliding coupling members 40 with respect to adjacent straps.

Just as the height of the coupled bag supporting and restraining straps such as 10 and 111 in FIG. 5 are adjustable, so is the base ring 60 diameter. Base ring 60 is shown in greater detail in FIGS. 6–8, wherein dimples 31 and protruding bumps 41 may be seen. However, since the direction of engagement is known for ring base 60, dimples 31 and protruding bumps 41 only need to be provided on but one side. Indeterminate length strap section 61 will most preferably be formed into a closed loop and passed through guides 62, 63, allowing and encouraging bumps 41 to frictionally engage with dimples 31 when in proper alignment. Once again, these bumps 41 and dimples 31 are configured most preferably to provide sufficient resistance to motion to stay put and withstand the forces within the dishwasher, while being readily moved manually when desired. While couplings similar to coupling member 40 could be used, in the preferred embodiment, couplings 63, 64 are used to retain the end of indeterminate length strap section 61 in place.

The most preferred embodiment of the invention illustrated in the figures will most preferably offer stain and color damage resistance, will remain flexible and pliant, and will withstand the most elevated dishwasher temperatures while still retaining physical support for a bag supported thereon. In other words, the material will withstand the temperatures without softening too much to remain effective. The material will also most preferably not significantly degrade upon repeated exposure to the various cleaning compounds used within automatic dishwashers. Nylon has been determined to be one suitable material, though a myriad of other polymers may be determined to be suitable or provide even better performance, including such materials as polyamides, polyimides, ultra-high molecular weight (UHMW) polyethylene, high-density polyethylene, polypropylene, polyester, and other materials. Metal, particularly where coated with a polymeric coating, plating or combination thereof to prevent corrosion, such as a polyvinyl chloride coating or other type of anti-corrosive coating, with or without zinc plating or the like, may also be used. However, polymers are most preferred owing to the ability to mold therein coupling member 40, dimples 31, and protruding bumps 41, as shown in the preferred embodiments of the illustrations, and, of course, owing to the intrinsic corrosion resistance and flexibility. Adjustable coupling is most preferred, owing to the wide variations in size between the various bags that are commercially sold.

The coupling of two adjacent bag supporting and restraining straps such as 10 and 11 in FIG. 5, that do not overlap, is preferred in the present invention. This arrangement keeps the corners of the bags open. When the loops overlap in the center, which is a ready adaptation of the present apparatus, the corners of the bag are not supported as well, and tend to flap downwards, potentially trapping dirty liquids within the bag and thereby preventing the bag from being completely cleaned.

The preferred embodiments illustrated herein offer compact packaging and storage, which is advantageous from the standpoint of production, warehousing and shipping, and also after retail sales in the less common event when a consumer wishes to store one or more of the present invention in a kitchen drawer or the like. In practice, the present invention will in most households be found almost exclusively within the dishwasher.

As can be seen from the figures, special keyhole shaped slots 21 permit the preferred embodiment to be twisted into engagement with a dishwasher rack, allowing the most preferred bag washing apparatus 15 to be moved around as required to accommodate different dishes within the dishwasher. This simple twisting motion is both simple and quick.

While the foregoing details what is felt to be the preferred embodiment of the invention, no material limitations to the scope of the claimed invention are intended. The possible variants that would be possible from a reading of the present disclosure are too many in number for individual listings herein, though they are understood to be included in the present invention. Further, features and design alternatives that would be obvious to one of ordinary skill in the art are considered to be incorporated herein. The scope of the invention is set forth and particularly described in the claims hereinbelow.

We claim:

1. A plastic bag support for retaining a plastic bag to assist with cleaning and drying thereof, comprising:

at least two vertically extending bag supporting and restraining straps, each having an indeterminate length resilient body and a bag retainer;

at least one of said at least two vertically extending bag supporting and restraining straps having a coupling member suitable for engaging an indeterminate length body and coupling said at least one of said at least two vertically extending bag supporting and restraining straps to an indeterminate length body of another of said at least two vertically extending bag supporting and restraining straps at a coupling location that is adjustable through a range of positions; and a means for engaging a dishwasher rack.

2. The plastic bag support of claim 1, wherein said bag retainer further comprises a bag retaining clip and at least one counter-facing protrusion opposed to said bag retaining clip.

3. The plastic bag support of claim 2, wherein said bag retaining clip and said at least one counter-facing protrusion each further comprise a first sloping surface active upon bag insertion, and a second sloping surface active upon bag removal that is more steeply sloped than said first sloping surface.

4. The plastic bag support of claim 3, wherein said second sloping surface is further comprised by a face which extends substantially transverse to said indeterminate length.

5. The plastic bag support of claim 1, further comprising:

dimples in a one of said at least two vertically extending bag supporting and restraining straps; and mating protruding bumps in a second one of said at least two vertically extending bag supporting and restraining straps;

said bumps and dimples cooperative when mated to produce resistance to relative motion between said one and said second one of said at least two vertically extending bag supporting and restraining straps.

6. The plastic bag support of claim 5, further comprising:

dimples on at least two surfaces in each one of said at least two vertically extending bag supporting and restraining straps; and mating protruding bumps on at least two surfaces in each one of said at least two vertically extending bag supporting and restraining straps;

said bumps and dimples cooperative when mated to produce resistance to relative motion between said one and said second one of said at least two vertically extending bag supporting and restraining straps.

7. The plastic bag support of claim 1, wherein said coupling member further comprises two resilient opposed members between which said another of said at least two vertically extending bag supporting and restraining straps is received through resilient deformation.

8. The plastic bag support of claim 7, wherein said two resilient opposed members further comprise "L" shaped arms protruding from said at least one of said at least two vertically extending bag supporting and restraining straps.

9. The plastic bag support of claim 1, further comprising at least one base ring strap formed into a circular configuration for supporting said at least two vertically extending straps.

10. The plastic bag support of claim 9, wherein said at least two vertically extending straps each further comprise a base ring engaging slot which encircles said at least one base ring strap.

11. The plastic bag support of claim 10, wherein said base ring engaging slot and said at least one base ring strap interfere to maintain said at least two vertically extending straps in a vertical orientation.

12. The plastic bag support of claim 1, wherein each of said at least two vertically extending bag supporting and restraining straps further comprise a base member having an anchor which is adapted to be removably affixed to a dishwasher rack.

13. In combination, a plastic bag, a dishwasher rack, and a bag holder having at least two vertically extending flexible and resilient straps serving to support said bag and having a releasable attachment to said dishwasher rack, said at least two vertically extending flexible and resilient straps comprising a coupling member coupling said at least two vertically extending flexible and resilient straps together at a coupling location that is adjustable through a range of positions to vary a combined length of said at least two vertically extending flexible and resilient straps.

14. The combination plastic bag, dishwasher rack, and bag holder of claim 13, wherein said bag holder releasable attachment further comprises a bag retaining clip and two counter-facing protrusions opposed to and adjacent about said bag retaining clip.

15. The combination plastic bag, dishwasher rack, and bag holder of claim 14, wherein said bag retaining clip and said two counter-facing protrusion each further comprise a first sloping surface active upon bag insertion, and a second sloping surface active upon bag removal that is more steeply sloped than said first sloping surface.

16. The combination plastic bag, dishwasher rack, and bag holder of claim 13, further comprising:

dimples in a one of said at least two vertically extending flexible and resilient straps; and mating protruding bumps in a second one of said at least two vertically extending flexible and resilient straps;

said bumps and dimples cooperative when mated to produce resistance to relative motion between said one and said second one of said at least two vertically extending flexible and resilient straps.

17. The combination plastic bag, dishwasher rack, and bag holder of claim 13, wherein each of said at least two vertically extending flexible and resilient straps further comprise a base member having an anchor which is adapted to be removably affixed to a dishwasher rack.

18. The combination plastic bag, dishwasher rack, and bag holder of claim 17, wherein said anchor further comprises a resilient keyhole-shaped opening in said base member.

19. A method of washing a plastic bag in an automatic dishwasher, comprising the steps of:

aligning a first linear bag supporting and restraining strap with a second linear bag supporting and restraining strap;

pressing said aligned first linear bag supporting and restraining strap transversely to a longitudinal axis against said second bag supporting and restraining strap to engage an operatively stable coupling therebetween;

folding said first and second bag supporting and restraining straps into a loop;

engaging said coupled and folded first and second bag supporting and restraining straps with said automatic dishwasher;

sliding said first bag supporting and restraining strap relative to said second bag supporting and restraining strap to adjust a combined length to coincide with an interior opening in said plastic bag; and affixing said plastic bag to said coupled first and second bag supporting and restraining straps.

* * * * *